US006167898B1

(12) United States Patent
Larga et al.

(10) Patent No.: US 6,167,898 B1
(45) Date of Patent: Jan. 2, 2001

(54) TENT WITH INTEGRAL AIR MATTRESS

(76) Inventors: Lou Larga; George Miljkovic, both of 47 Grassington Cres, Brampton, Ontario L6S 1Z5 (CA)

( * ) Notice: Under 35 U.S.C. 154(b), the term of this patent shall be extended for 0 days.

(21) Appl. No.: 09/552,785

(22) Filed: Apr. 20, 2000

Related U.S. Application Data

(63) Continuation of application No. 08/833,930, filed on Apr. 10, 1997, now abandoned.

(51) Int. Cl.[7] ..... E04H 15/36

(52) U.S. Cl. ..... 135/137; 135/124; 135/135

(58) Field of Search ..... 135/98, 99, 96, 135/133, 135, 137, 147, 151; 52/2.11, 2.18, 2.19, 2.21, 2.22, 2.24; 5/417–420, 710, 711, 737, 728, 922, 923

(56) References Cited

U.S. PATENT DOCUMENTS

| | | | | |
|---|---|---|---|---|
| D. 285,880 | | 9/1986 | Griesenbeck . | |
| D. 330,745 | | 11/1992 | Fogle . | |
| 4,000,585 | | 1/1977 | Denaro . | |
| 4,332,112 | * | 6/1982 | Hsu | 52/2.21 |
| 4,335,545 | | 6/1982 | Couch . | |
| 4,558,713 | | 12/1985 | Hagler et al. . | |
| 4,590,956 | | 5/1986 | Griesenbeck . | |
| 4,665,935 | | 5/1987 | Nichols . | |
| 4,750,509 | | 6/1988 | Kim . | |
| 4,766,918 | | 8/1988 | Odekirk . | |
| 4,819,389 | | 4/1989 | Kihn . | |
| 4,876,829 | | 10/1989 | Mattick . | |
| 4,928,442 | | 5/1990 | Kroetch et al. . | |
| 5,007,212 | | 4/1991 | Fritts et al. . | |
| 5,487,400 | | 1/1996 | Dawkins . | |
| 5,562,115 | | 10/1996 | Sotelo . | |
| 5,615,521 | | 4/1997 | Simerka . | |
| 5,632,291 | | 5/1997 | Botbyl et al. . | |
| 5,642,750 | | 7/1997 | Brown et al. . | |
| 5,660,197 | | 8/1997 | Boe et al. . | |
| 5,669,182 | | 9/1997 | Griffis . | |
| 5,864,908 | * | 2/1999 | Kielman | 5/738 |
| 5,913,322 | * | 6/1999 | Gallant et al. | 135/137 |

* cited by examiner

*Primary Examiner*—Richard Chilcot

(57) ABSTRACT

A tent with integral air mattress for improving camping comfort and including a base member composed of a bottom, water resistant layer and at least one inflatable air mattress attached to the top of the bottom layer. A support frame extends upward from the base member and supports a fabric shell so as to define a tent interior. The bottom surface of the bottom layer includes a series of intersecting grooves for permitting air flow and water flow underneath the tent. The shell is attached to a skirt member which extends from the base member. The air mattress does not cover the entire top surface of the bottom layer, so that a portion of the bottom layer adjacent the door of the tent is exposed, forming a flat area suitable for placing shoes and other gear thereon. The support frame preferably comprises a plurality of telescoping support poles which can be locked in an extended position through a twisting motion of the support poles.

14 Claims, 5 Drawing Sheets

TENT WITH INTEGRAL AIR MATTRESS

CROSS REFERENCE TO RELATED APPLICATION

This application is a substitute for application Ser. No. 08/833,930, filed Apr. 10, 1997, now abandoned.

BACKGROUND OF THE INVENTION

1. Field of the Invention

The present invention relates to tents and more particularly pertains to a new tent with integral air mattress for improving camping comfort.

2. Description of the Prior Art

The use of tents is known in the prior art. More specifically, tents heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,335,545; U.S. Pat. No. 4,000,585; U.S. Pat. No. 4,819,389; U.S. Pat. No. 4,928,442; U.S. Pat. Des. 330,745; and U.S. Pat. Des. 285,880.

While these devices fulfill their respective, particular objectives and requirements, the aforementioned patents do not disclose a new tent with integral air mattress. The inventive device includes a base member composed of a bottom, water resistant layer and at least one inflatable air mattress attached to the top of the bottom layer. A support frame extends upward from the base member and supports a fabric shell so as to define a tent interior. The bottom surface of the bottom layer includes a series of intersecting grooves for permitting air flow and water flow underneath the tent. The shell is attached to a skirt member which extends from the base member. The air mattress does not cover the entire top surface of the bottom layer, so that a portion of the bottom layer adjacent a door of the tent is exposed, forming a flat area suitable for placing shoes and other gear thereon.

The invention further includes a tent structure having a support frame comprised of a plurality of support poles made of a series of telescoping pole elements. A locking means is provided to lock the pole elements in an extended position. The locking means comprises a tongue and groove arrangement which are engaged/disengaged through twisting movements of the pole elements. A central hub element is provided which receives the ends of the support poles and locks them in place using locking springs.

In these respects, the tent with integral air mattress according to the present invention substantially departs from the conventional concepts and designs of the prior art, and in so doing provides an apparatus primarily developed for the purpose of improving camping comfort.

SUMMARY OF THE INVENTION

In view of the foregoing disadvantages inherent in the known types of tents now present in the prior art, the present invention provides a new tent with integral air mattress construction wherein the same can be utilized for improving camping comfort.

The general purpose of the present invention, which will be described subsequently in greater detail, is to provide a new tent with integral air mattress apparatus and method which has many of the advantages of the tents mentioned heretofore and many novel features that result in a new tent with integral air mattress which is not anticipated, rendered obvious, suggested, or even implied by any of the prior art tents, either alone or in any combination thereof.

To attain this, the present invention generally comprises a base member composed of a bottom, water resistant layer and at least one inflatable air mattress attached to the top of the bottom layer. A support frame extends upward from the base member and supports a fabric shell so as to define a tent interior. The bottom surface of the bottom layer includes a series of intersecting grooves for permitting air flow and water flow underneath the tent. The shell is attached to a skirt member which extends from the base member. The air mattress does not cover the entire top surface of the bottom layer, so that a portion of the bottom layer adjacent a door of the tent is exposed, forming a flat area suitable for placing shoes and other gear thereon.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tent with integral air mattress apparatus which has many of the advantages of the tents mentioned heretofore and many novel features that result in a new tent with integral air mattress which is not anticipated, rendered obvious, suggested, or even implied by any of the prior art tents, either alone or in any combination thereof.

It is another object of the present invention to provide a new tent with integral air mattress which may be easily and efficiently manufactured and marketed.

It is a further object of the present invention to provide a new tent with integral air mattress which is of a durable and reliable construction.

An even further object of the present invention is to provide a new tent with integral air mattress which is susceptible of a low cost of manufacture with regard to both materials and labor, and which accordingly is then susceptible of low prices of sale to the consuming public, thereby making such tent with integral air mattress economically available to the buying public.

Still yet another object of the present invention is to provide a new tent with integral air mattress which provides in the apparatuses and methods of the prior art some of the advantages thereof, while simultaneously overcoming some of the disadvantages normally associated therewith.

Still another object of the present invention is to provide a new tent with integral air mattress for improving camping comfort.

Yet another object of the present invention is to provide a new tent with integral air mattress which includes a base member composed of a bottom, water resistant layer and at least one inflatable air mattress attached to the top of the bottom layer. A support frame extends upward from the base member and supports a fabric shell so as to define a tent interior. The bottom surface of the bottom layer includes a series of intersecting grooves for permitting air flow and water flow underneath the tent. The shell is attached to a skirt member which extends from the base member. The air mattress does not cover the entire top surface of the bottom layer, so that a portion of the bottom layer adjacent a door of the tent is exposed, forming a flat area suitable for placing shoes and other gear thereon.

Another object of the present invention is to provide a new tent which uses telescoping support poles which collapse to a small size making transport of the tent apparatus easier.

Still yet another object of the present invention is to provide a new tent with integral air mattress that reduces the amount of equipment which needs to be carried while camping.

Even still another object of the present invention is to provide a new tent with integral air mattress that reduces the discomfort and back pain normally associated with sleeping in tents.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
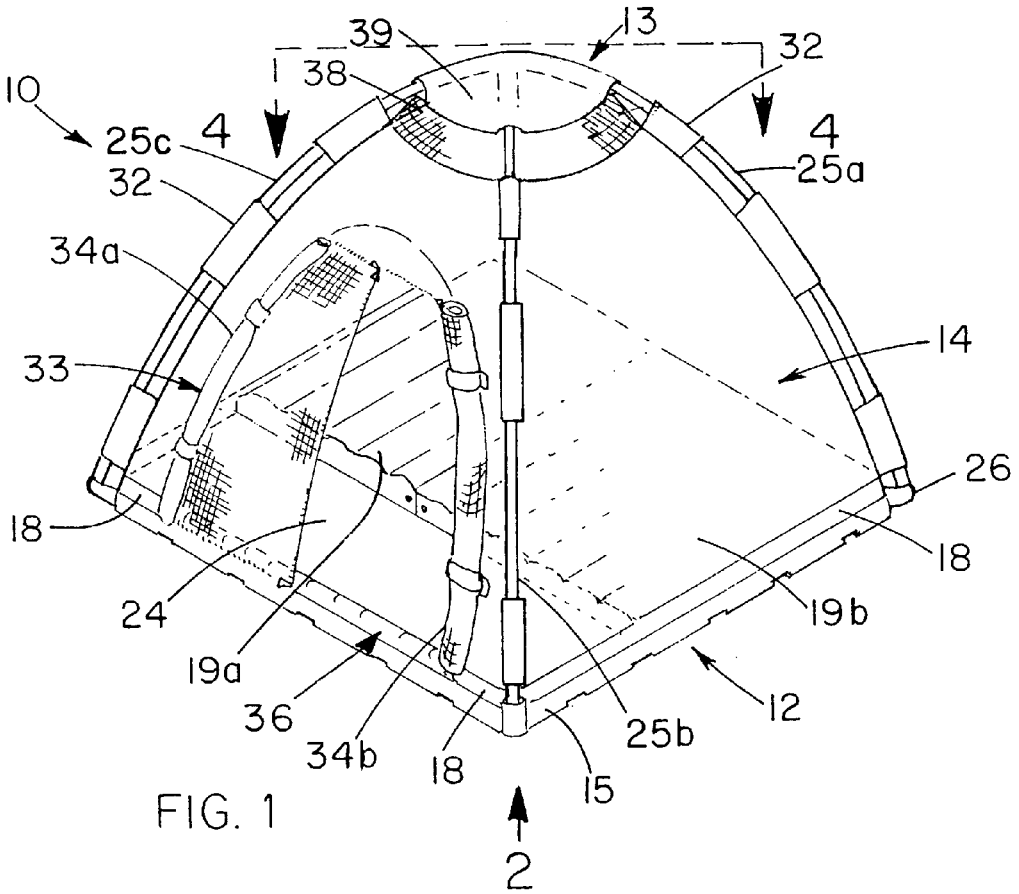
FIG. 1 is a perspective view of a new tent with integral air mattress according to the present invention.
Figure 2B:
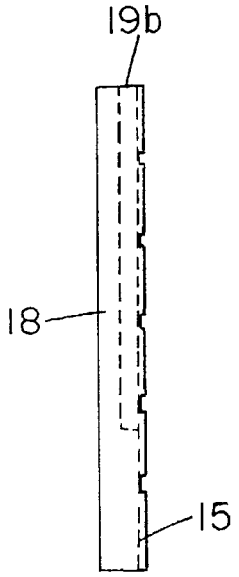
FIG. 2B is a side view of the base member only, looking in the direction of line 2B—2B in FIG. 2A.
Figure 2A:
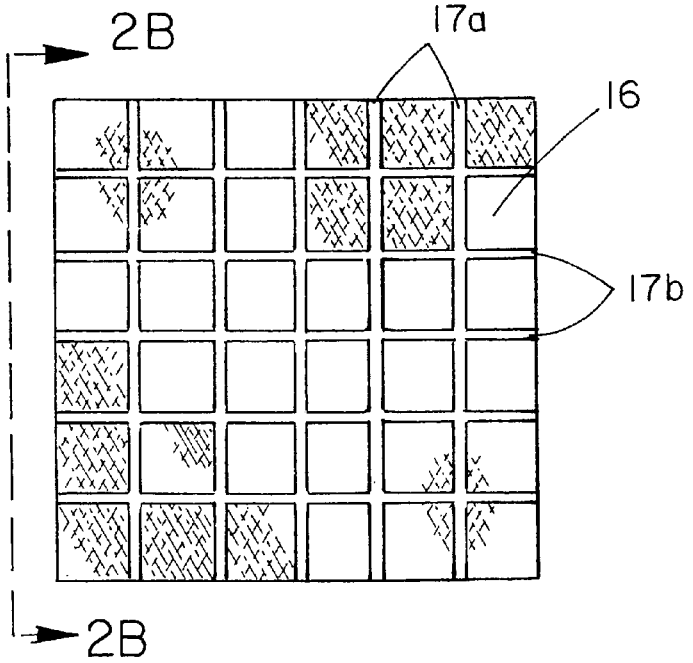
FIG. 2A is a bottom view of the tent looking generally in the direction of the arrow 2 in FIG. 1.
Figure 3:
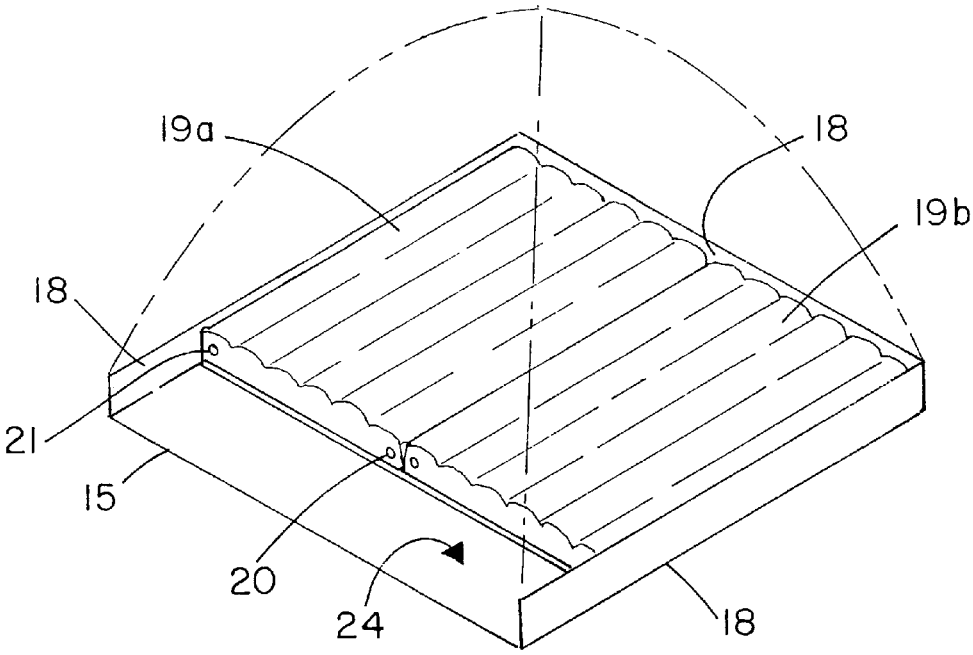
FIG. 3 is a perspective view of the base member with the shell shown in dashed lines for clarification.

With reference now to the drawings, and in particular to FIGS. 1 through 10 thereof, a new tent with integral air mattress embodying the principles and concepts of the present invention and generally designated by the reference numeral 10 will be described.

As best illustrated in FIGS. 1 through 10, the tent with integral air mattress 10 comprises a base member 12 supported upon the ground, a support frame 13 extending upwardly from the base member, and a shell 14 attached to the base member and supported by the frame 13.

The base member 12, as best illustrated in FIGS. 1, 2A–B, and 3, is composed of a bottom layer 15 of a water resistant material, such as rubber, or the like. The layer 15 rests directly upon the ground and therefore it has a pre-selected thickness for cushioning and insulating the base member 12. The bottom surface 16 of the layer 15 includes a series of intersecting grooves 17*a, b* formed therein for permitting air and water to pass underneath the base member when it rests on the ground. The bottom surface 16 is also suitably roughened to prevent slippage of the base member upon the ground. Skirts 18 of the same material as the layer 15 extend upwards from the top surface of the layer 15, the purpose of which will become apparent later in the description.

The base member 12 also includes a pair of air mattresses 19*a*, 19*b* fixedly attached to the top surface of the bottom layer 15 using any suitable means. The air mattresses 19*a*, 19*b* are preferably made of a material capable of holding air and are covered in a soft material for improving the comfort of the mattresses. Such materials are generally known in the art and therefore no further discussion of them is needed. The mattresses 19*a*, 19*b* are generally identical, so only one will be described in detail, it being understood that the other one is similar.

Figure 9:
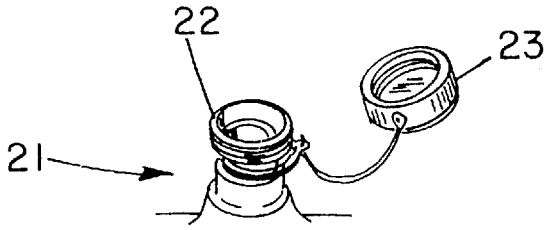
FIG. 9 illustrates the outlet port and cap for one of the mattresses.

The mattress 19*a* defines an enclosed chamber which is separate and distinct from the chamber defined by the mattress 19*b*. An air inlet port 20 of conventional configuration communicates with the chamber, permitting air to be input into the chamber, but preventing air escape. In addition, a separate air outlet port 21 communicates with the chamber for permitting rapid deflation of the mattress 19*a*. As shown in FIG. 9, the air outlet port 21 comprises an outlet nozzle 22 integral with the mattress and having a threaded end which engages with an internally threaded cap 23 for closing the nozzle 22 and preventing escape of air. The nozzle 22 is configured such that when the cap is removed, it allows air to freely exit the chamber of the mattress, such that the mattress can be rapidly deflated.

As illustrated, the mattresses 19*a*, 19*b* are disposed substantially side by side upon the layer 15, and have a thickness such that the skirts 18 extend upward above the top of the mattresses. However, the mattresses do not completely cover the entire top surface of the layer 15 such that a lowered area 24 is formed at the ends of the mattresses. The lowered area 24 thus comprises the portion of the layer 15 which is not covered by the mattresses. The lowered area 24 forms a suitable location for shoes and other equipment to be placed before climbing up on the mattresses. The shoes and equipment placed in the area 24 are kept from direct contact with the ground by the layer 15, thus keeping such items dry.

Figure 5:
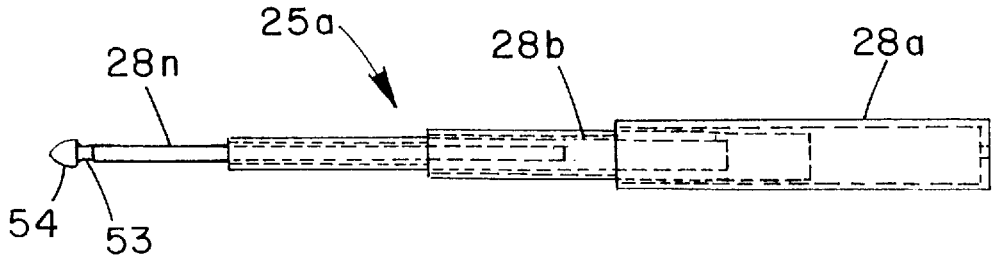
FIG. 5 illustrates a telescoping support pole.
Figure 6:
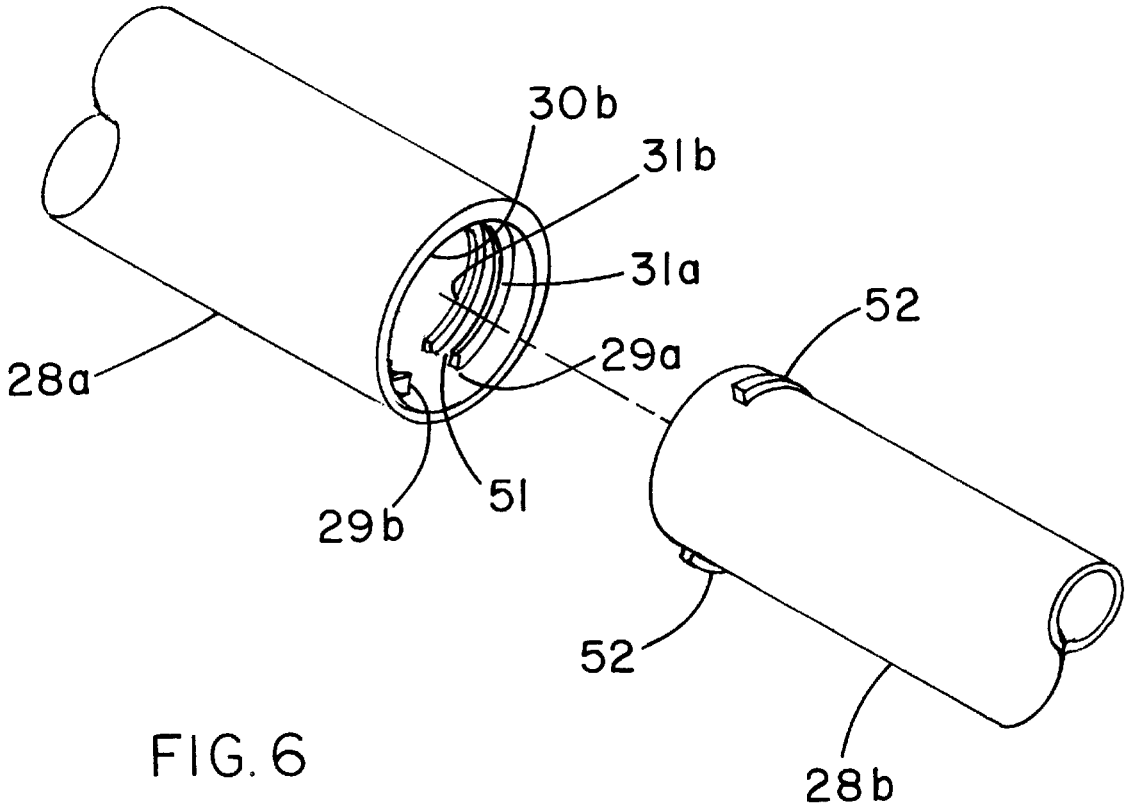
FIG. 6 is an exploded view of two of the telescoping pole elements and how they connect together.
Figure 7:
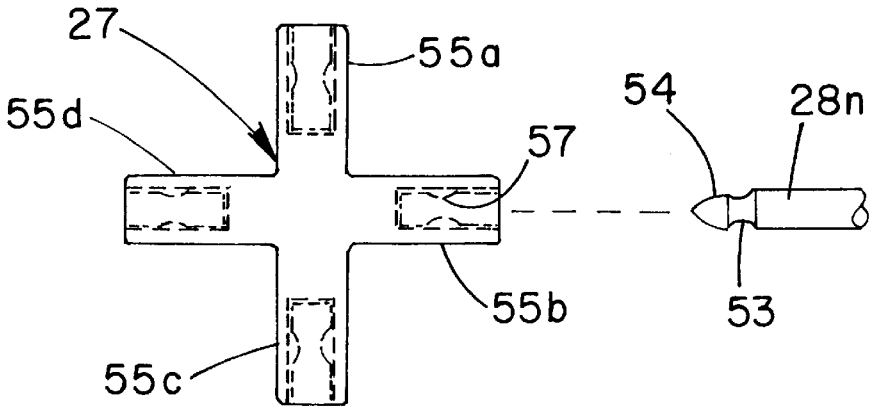
FIG. 7 is a view of the central hub element looking in the direction of line 7—7 of FIG. 8.
Figure 8:
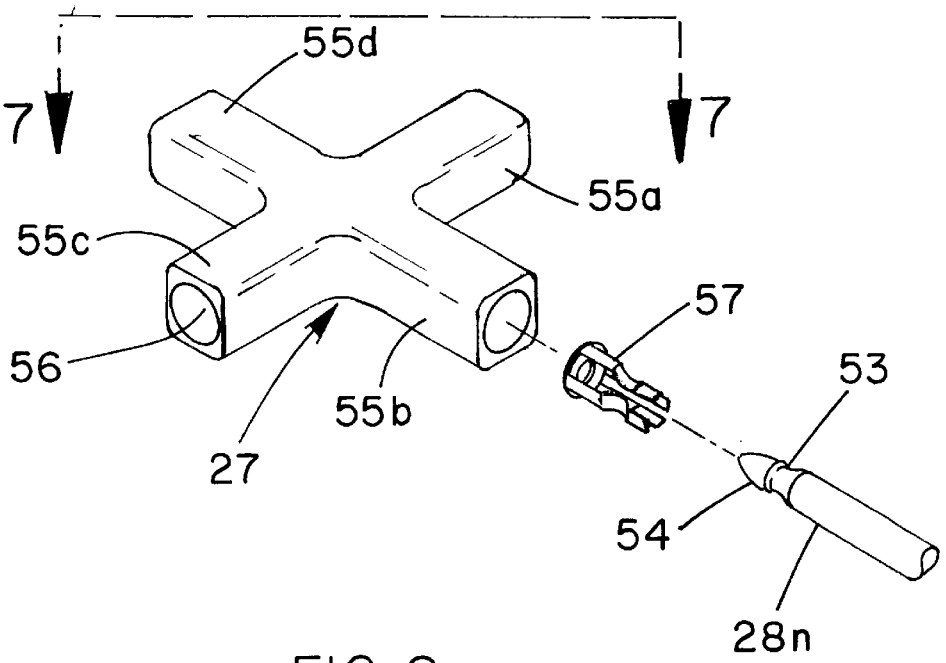
FIG. 8 is an exploded view of the central hub and all its elements.

The support frame 13 comprises four flexible, telescoping support poles 25*a*, 25*b*, 25*c*, 25*d* which each extend upward from a respective corner of the base member 12 and are connected thereto by being disposed within connectors 26 disposed at each corner of the base member. The opposite ends of the poles 25*a*, 25*b*, 25*c*, 25*d* are connected to a central hub element 27. Turning to FIG. 5, one of the telescoping support poles 25*a* is shown, it being understood that the remaining poles 25*b–d* are identical to the pole 25*a*. The pole 25*a* is composed of a series of telescoping pole elements 28*a*, 28*b* . . . *n* with the element 28*a* having a larger diameter than the element 28*b* which has a larger diameter than the next element, and so on. The support poles 25*a–d* can be comprised of any number of individual pole elements 28*a*, 28*b* . . . *n*. The elements 28*a* are adapted to fit within the connectors 26. The pole elements are thus able to be retracted into the largest pole element 28*a*, similar to an antenna, and extended out for use. A means for locking the pole elements in the extended position must therefore be provided. Such a means is illustrated in FIG. 6, where two of the pole elements 28*a*, 28*b* are shown. The interior wall of the element 28*a* includes a pair of circumferentially spaced shoulder assemblies 29*a*, 29*b* formed thereon, with the assemblies being separated by gaps 30*a*, 30*b*. Each shoulder assembly 29*a*, 29*b* comprises a pair of axially spaced shoulders 31*a*, 31*b* defining a groove 51 therebetween. The pole element 28*b* includes at one end thereof a pair of projecting tongues 52 on diametrically opposite sides thereof. The tongues 52 are sized for fitting through the respective gaps 30*a*, 30*b*, so as to permit the pole element 28*b* to be telescoped into the pole element 28*a*. The pole element 28*b* is axially locked relative to the element 28*a* by axially aligning the tongues with the grooves 51 and rotating the elements relative to each other, so that the tongues are disposed within the grooves thus preventing axial movement of the element 28*b* relative to the element 28*a*. It should be understood that each of the pole elements includes a pair of projecting tongues at one end and a pair of shoulder assemblies on its interior at the other end, except for the two end pole elements 28*a*, 28*n*. The pole element 28*n* includes only the projecting tongues. Thus each of the pole elements is locked in a similar fashion to the connection between the elements 28*a*, 28*b*. As can be seen in FIGS. 5 and 7–9, the distal end of each support pole (i.e. pole elements 28*n*) includes a neck region 53 followed by a bulbous tip 54, the purpose of which will become apparent later in the description. It is preferable that the pole elements 28*a*, 28*b* . . . *n* be made of a graphite material such that it is able to be flexed into an arched configuration.

The central hub element 27, which receives the ends of the support poles 25*a*–25*d*, comprises a solid, cross shaped member having four arms 55*a*–55*d*, with each arm having an aperture 56 formed therein. Disposed within each aperture 56 is a locking spring 57 which is configured to matingly receive the neck region 53 and bulbous end 54 of the support poles, to secure the distal ends of the poles within the hub element 27. The distal ends of the poles are thus frictionally retained within the apertures 56 by frictional engagement with the springs 57. The ends can be removed from the hub by a simple pulling force applied to the pole element 28*n*.

The shell 14 is supported by the support poles 25*a–d* so as to define a tent interior area. The shell 14 is comprised of a series of nylon panels connected to each other to define the walls of the tent 10. The base of the shell 14 is affixed to the skirts 18 such as by stitching and/or gluing, in order to form a watertight connection between the shell and the base member 12. Therefore the shell 14 is permanently attached to the base member 12. The shell 14 includes a plurality of spaced, nylon sleeves 32 attached thereto, such as by stitching, through which extend the poles 25*a–d* for supporting the shell.

One of the panels of the shell 14 includes a door means 33 formed therein. The door means 33 comprises a pair of outer flaps 34*a*, 34*b* which preferably are a part of the shell 14. The flaps 34*a*, 34*b* are integral at one edge thereof with the shell 14, while the remaining edges are removably secured by zippers, as is conventional. The door means 33 also includes an inner mesh screen composed of separate mesh flaps 35*a*, 35*b* appropriately affixed to the inside of the shell 14 as is also conventional. The mesh screen permits fresh air to enter the interior of the tent when the flaps are moved out of the way, while keeping out bugs.

Figure 4:
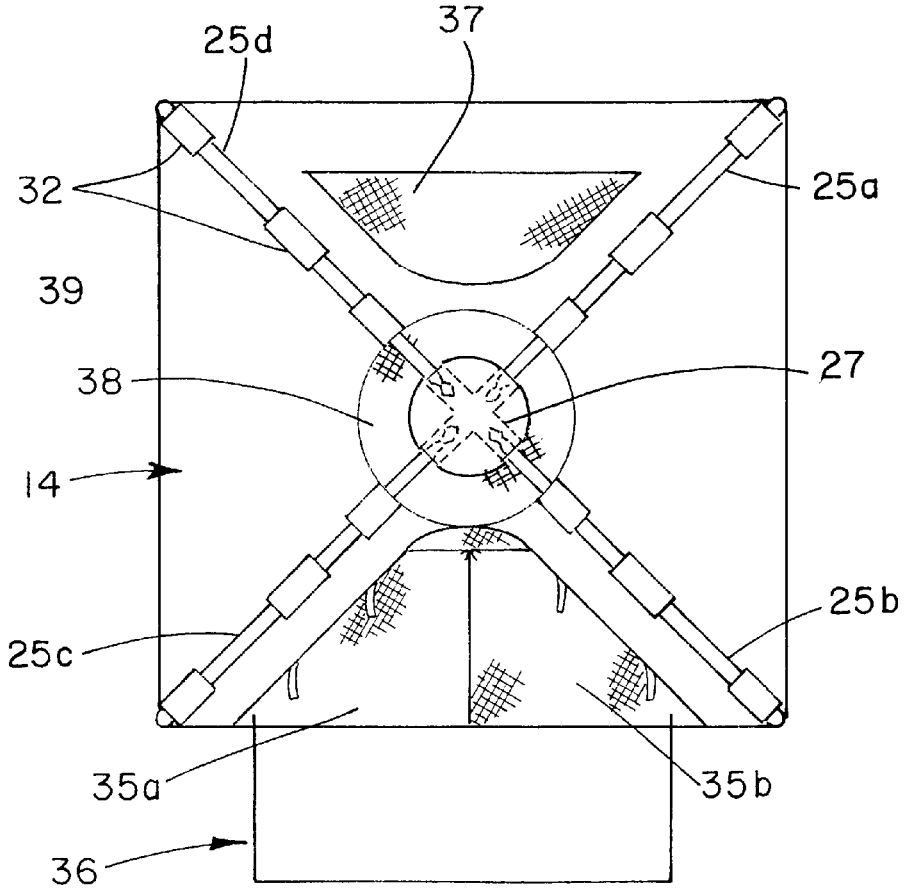
FIG. 4 is a top view of the tent looking generally in the direction of the line 4—4 in FIG. 1.

As best shown in FIG. 4, the tent 10 includes a door mat means 36 which can be rolled onto the ground in front of the door means 33. The door mat means 36 comprises a flexible sheet material which is integrally connected along one edge thereof to the base member 12. The sheet is preferably rolled-up when not in use, as illustrated in FIG. 1, for storage within the tent. To use, the door means is opened, allowing the sheet to be unrolled in front of the area of the door means.

The side of the shell 14 opposite the door means 33 includes a mesh screen window 37 therein, so as to permit fresh air flow into the tent. The shell 14 also includes a donut shaped, mesh screen sun roof 38 adjacent the top thereof for further increasing air flow and sunlight into the tent. A central fabric area 39 encloses the hub element 27 and is suitably attached to the mesh sun roof 38 so as to secure the fabric area and the hub element to the tent 10. The central fabric area 39 comprises a fabric layer above and below the central hub element 27 and stitched together so as to secure the hub element between the layers. Apertures are provided between the layers, aligned with the holes 56, in order to allow passage of the pole elements 28*n* so that they can be inserted into the hub element. Preferably, means are provided within the tent so as to permit selective covering and uncovering of the window 37 and the sun roof 38. The mesh flaps 35*a*, 35*b*, mesh window 37, and mesh sun roof 38 are preferably formed of a UV resistant mesh material to protect the occupants of the tent from the harmful effects of UV rays from sunlight.

Figure 10:
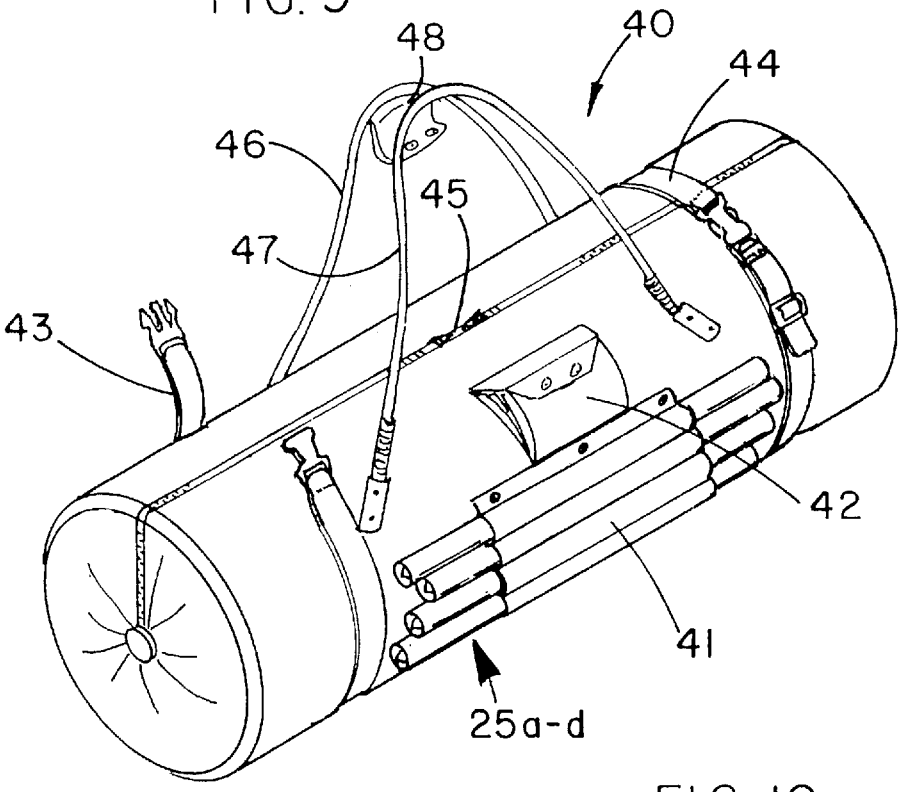
FIG. 10 illustrates a bag for carrying the tent.

FIG. 10 illustrates a carrying bag 40 which can be used to carry the tent 10 when it is not assembled. The bag 40 defines an interior volume for holding the base member and shell, and includes an exterior sleeve 41 for holding the telescoping poles 25*a*–25*d*. The bag also includes a pocket 42 for holding miscellaneous items such as a mattress repair kit. A pair of adjustable, locking straps 43, 44 are used to close the bag. The bag can also include a conventional zipper connection 45 for gaining access to the interior of the bag. In order to provide for easy carrying of the bag, a pair of handles 46, 47 are attached thereto, and can be secured together using a conventional strap member 48.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A tent structure, comprising:

a base member;

a support frame extending upward from the base member; and a fabric shell supported by the support frame so as to define a tent interior, the shell including a door therein located adjacent to the base member for permitting access the tent interior, the door having a door width extending along the base member;

wherein the base member comprises a bottom layer having top and bottom surfaces and made of a water resistant material, and at least one inflatable air mattress attached to the top surface of the bottom layer; and a door mat adapted for persons to wipe their shoes before entering the door; the door mat being connected to the base member adjacent to the door and extending out from the base member at a location adjacent to the door for placement on the ground adjacent to the door;

wherein the door mat comprises a sheet material connected along one edge thereof to the base member, the length of the one edge defining the length of the door mat, the sheet material being flexible, the length of the door mat being shorter than the door width such that the flexible door mat can be rolled up and disposed inside the tent interior for convenient storage.

2. The tent structure of claim 1, wherein the bottom layer includes a series of intersecting grooves formed in the bottom surface thereof for permitting air flow and water flow under the base member.

3. The tent structure of claim 1, wherein the bottom layer includes a skirt extending upward therefrom, the skirt being attached to the fabric shell.

4. The tent structure of claim 3, wherein the skirt extends upward beyond the top of the at least one inflatable air mattress.

5. The tent structure of claim 1, further including an additional air mattress attached to the top surface of the bottom layer, each air mattress defining an enclosed chamber, the enclosed chambers being separate and distinct from each other.

6. The tent structure of claim 5, wherein each enclosed chamber includes an inlet port and an outlet port in communication therewith.

7. The tent structure of claim 6, wherein each outlet port includes a removable cap attached thereto, the outlet ports being configured such that when the caps are removed, air is allowed to freely exit the enclosed chambers.

8. The tent structure of claim 1, wherein the at least one air mattress extends along only a portion of the top surface of the bottom layer so as to leave a predetermined portion of the top surface exposed, and wherein the exposed top surface is located adjacent the door means.

9. The tent structure of claim 1, wherein the support frame comprises a plurality of support poles, each support pole including a plurality of telescoping pole elements.

10. The tent structure of claim 9, further including a central hub element disposed at the top of the shell, each support pole including a distal end which is connected to the central hub.

11. The tent structure of claim 10, wherein the central hub element includes a plurality of openings therein, each opening having a locking spring disposed therein, and the distal ends of the support poles being disposed within the openings and shaped for locking engagement with the locking springs.

12. The tent structure of claim 9, further including means for locking the telescoping pole elements in an extended position so as to prevent telescoping movements of the pole elements.

13. The tent structure of claim 9, wherein the fabric shell includes a plurality of sleeves attached thereto through which the support poles extend for supporting the shell on the frame.

14. A tent structure, comprising:

a base member;

a support frame extending upward from the base member;

a fabric shell supported by the support frame so as to define a tent interior, the shell including a door therein located adjacent to the base member for permitting access the tent interior, the door having a door width extending along the base member;

wherein the base member comprises a bottom layer having top and bottom surfaces and made of a water resistant material, and a first inflatable air mattress attached to the top surface of the bottom layer;

wherein the bottom layer includes a series of intersecting grooves formed in the bottom surface thereof for permitting air flow and water flow under the base member;

wherein the bottom layer includes a skirt extending upward therefrom, the skirt being attached to the fabric shell;

wherein the skirt extends upward beyond the top of the inflatable air mattress;

a second air mattress attached to the top surface of the bottom layer, each air mattress defining an enclosed chamber, the enclosed chambers being separate and distinct from each other;

wherein each enclosed chamber includes an inlet port and an outlet port in communication therewith;

wherein each outlet port includes a removable cap attached thereto, the outlet ports being configured such that when the caps are removed, air is allowed to freely exit the enclosed chambers;

wherein the second air mattress extends along only a portion of the top surface of the bottom layer so as to leave a predetermined portion of the top surface exposed;

wherein the exposed top surface is located adjacent the door;

a generally rectangular door mat adapted for persons to wipe their shoes before entering the door, the door mat being connected to the base member adjacent to the door and extending out from the base member at a location adjacent to the door for placement on the ground adjacent to the door;

wherein the door mat comprises a sheet material connected along one edge thereof to the base member, the length of the one edge defining the length of the door mat, the sheet material being flexible, the length of the door mat being shorter than the door width such that the flexible door mat can be rolled up and disposed inside the tent interior for convenient storage;

wherein the support frame comprises a plurality of support poles, each the support pole including a plurality of telescoping pole elements;

a central hub element disposed at the top of the shell, each the support pole including a distal end which is connected to the central hub;

wherein the central hub element includes a plurality of openings therein, each the opening having a locking spring disposed therein, and the distal ends of the support poles being disposed within the openings and shaped for locking engagement with the locking springs;

a means for locking the telescoping pole elements in an extended position so as to prevent telescoping movements of the pole elements; and wherein the fabric shell includes a plurality of sleeves attached thereto through which the support poles extend for supporting the shell on the frame.

* * * * *